United States Patent [19]

Mitzel

[11] 4,261,559

[45] Apr. 14, 1981

[54] STACKER FOR FLAT MATERIAL

[75] Inventor: Wilhelm Mitzel, Neukeferloh, Fed. Rep. of Germany

[73] Assignee: GAO Gesellschaft fur Automation und Organisation, Munich, Fed. Rep. of Germany

[21] Appl. No.: 50,978

[22] Filed: Jun. 22, 1979

[30] Foreign Application Priority Data

Dec. 29, 1978 [DE] Fed. Rep. of Germany ..... 2856777

[51] Int. Cl.[3] ..... B65H 29/24

[52] U.S. Cl. ..... 271/196; 271/184; 271/276

[58] Field of Search ..... 271/196, 194, 195, 197, 271/276, 94, 95, 96, 184–186; 414/72, 73, 121, 128

[56] References Cited

U.S. PATENT DOCUMENTS

| | | | |
|---|---|---|---|
| 2,804,974 | 9/1957 | Noon | 271/96 X |
| 3,127,168 | 3/1964 | Kramer | 271/96 |
| 3,131,929 | 5/1964 | Rehm | 271/94 |
| 3,148,876 | 9/1964 | Chandler et al. | 271/94 X |
| 4,073,487 | 2/1978 | Schirrmeister et al. | 271/196 X |

FOREIGN PATENT DOCUMENTS 1102640 3/1961 Fed. Rep. of Germany .

*Primary Examiner*—Bruce H. Stoner, Jr.
*Attorney, Agent, or Firm*—Andrus, Sceales, Starke & Sawall

[57] ABSTRACT

A stacker apparatus for flat sheet material has a suction drum rotating on a stator. The suction drum grips the flat sheet material at one tangential position, arcuately moves it, and releases it on a stack at a second tangential position. The suction drum has a section containing a plurality of suction openings for gripping the sheet material. A plurality of peripheral suction channels on the stator communicate with the suction openings. The width of the suction channels decreases step-wise along their length so that the suction openings are initially in full communication with the channels, thereafter the suction openings are partially closed, and finally, selected ones of the suction openings are completely closed as the drum rotates.

6 Claims, 10 Drawing Figures

STACKER FOR FLAT MATERIAL

BACKGROUND OF THE PRESENT INVENTION

The invention relates to a stacker for flat material such as banknotes, bankpapers and the like, with a cylindrical suction drum, whose casing along at least one generatrix has a line of suction openings, and with a stator, on which the suction drum is turningly bearinged, whose outer face has suction air-ways stretching in the peripheral direction over a certain angle range, and by way of which the suction openings are joined with vacuum dependent on their position in relation to the stator, and the suction drum is designed for suction-gripping, in its suction part, of the material in the tangential point at the leading edge, taking it from the transport system on being further turned, moving it to a clearing unit and letting it off with the forming stack at the point at which the clearing unit takes effect.

In this connection a suggestion has been made earlier in the German Offenlegungsschrift specification No. 2,555,306 for the use of a stacker generally made up of a hollow cylindrical stacker drum turning about the axis of a stator, and a transport system for moving the banknotes to the drum. The stacker drum has a line of suction openings parallel to its long-axis on the outer face of the drum casing. The banknotes are moved to the drum by way of the transport system which is tangential with respect to the stacker drum. The line of suction openings of the stacker drum is so timed in its motion in relation to the line of banknotes being moved up to it that after each turn it comes up against the leading edges of the banknotes, being moved towards it in the timed order, at a tangential point. For stacking, the banknote, suction-gripped at the tangential point, is moved round on the stacker drum till its leading edge comes to the position of stopping, formed by a clearing unit, and is placed on any stack which has been formed here so far.

The suction connection for the line of suction openings is by way of sectorial airways machined in the stator. In this respect, the suction airway in the stator is so placed as to be stretching generally along an angle range from the tangential point to the clearing or stopping point, so that it is only in this range that the suction openings are able to be joined with the vacuum system at an unchanging vacuum level.

This stacker may be worked in the desired way as long as the banknotes are timed in their motion towards the stacker drum, that is to say as long as, in each case, the leading edge of each banknote comes up against the line of suction openings at the tangential point. In general operation it has, however, turned out—because a certain degree of slip in the transport system may not eliminate—the banknotes are not in all cases transported in the necessary timed relation, so that they are suction-gripped by the stacker drum overly early or are not gripped at all. In this respect the banknotes, which are suction-gripped overly early, after running up against the clearing unit, are still suction-gripped by the suction openings and forced against the clearing unit with the outcome that the leading edges are, in most cases, folded or even crumpled. Banknotes which are overly late in their timing and which are not gripped by the stacker, are moved on further uncontrolledly in the transport system and, more specially in connection with the banknotes coming after them, are responsible for the forcing together and jamming of banknotes and stopping of the system.

For overcoming the effects of errors in timing, it is possible for the stacker drum to have a number of suction opening lines, placed side-by-side, so that even after slip or different degrees of slip, the banknotes will still be suction-gripped. However, in this case operation will still not be completely as desired. One shortcoming is produced if a bankpaper getting to the stacker drum overly late does not come into position covering the front suction opening line. Although the suction-gripped banknote will be stacked, there will, however, be a danger of the uncovered suction openings suction-gripping the last banknote stacked beforehand and pushing it against the clearing unit, something which is generally responsible for folding in the case of banknotes in a poor condition. Furthermore, because the suction openings are only partly covered, there may be a great loss in the suction power.

For banknotes getting to the drum before their time, there are the same shortcomings with respect to stacking, as are produced in the case of the firstly noted stacker drum only having a single suction opening line. The leading edges of the banknotes are, in this case, forced violently against the clearing unit, because the complete suction range has an effect, and in most cases the banknotes are folded because of this.

SUMMARY OF THE PRESENT INVENTION

For these reasons, one purpose of the present invention is that of designing a stacker which within wide limits and without being dependent on the quality of the banknotes, certainly and unchangingly takes them up as they come to it within a certain rated slip range, and with the least possible loss in suction power, so that the banknotes are moved, without being dependent on the position of the leading edge, in a certain rated slip range to the true, desired position at the clearing unit, without the banknotes being folded and without the banknotes, placed on the stack earlier, being moved out of position.

This purpose is effected by the invention in that on the suction drum a number of lines of suction openings are placed one after the other in the direction of turning and on the stator a number of suction airways are placed one beside the other in the direction of turning and in that the position of the suction airways in relation to the suction openings is such that the connection of suction openings with suction airways generally at the tangential point is complete, is at the lowest value shortly before the point at which the flat material is run up against the clearing unit and inbetween the degree of covering up has an inbetween value. Further developments of the invention are claimed in the dependent claims.

More specially, the useful effect of the invention is to be seen in that even with the range of slip likely, and not to be overcome, in general operation, the banknotes are, in all cases, pulled into the stack as far as the point of stopping without the banknotes which are about to be placed on the stack, or have been placed on it earlier, being damaged or bent.

BRIEF DESCRIPTION OF THE DRAWING

An account will now be given of one working example of the invention making use of the accompanying figures.

DETAILED DESCRIPTION OF THE PREFERRED EMBODIMENT

Figure 1:
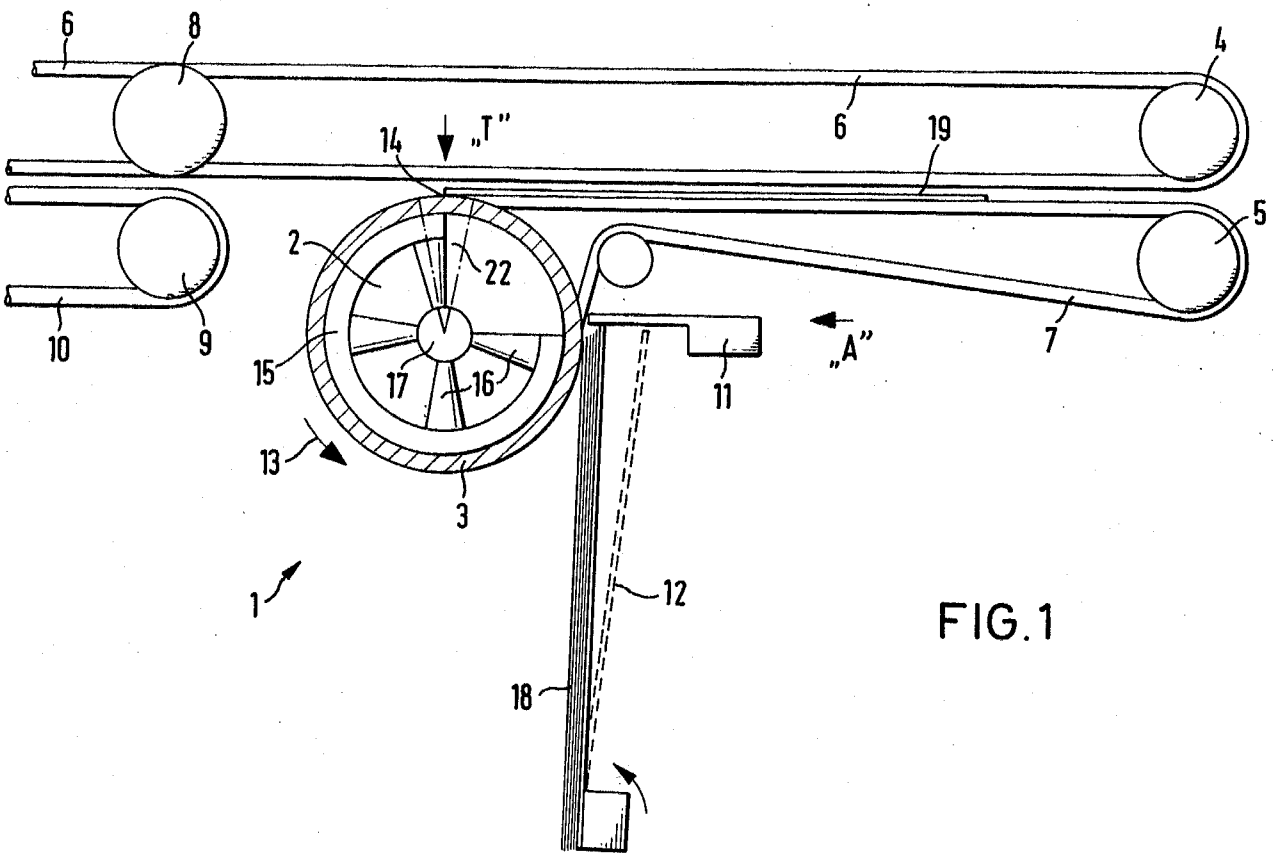
FIG. 1 is a schematic diagram in section of the stacker.

As will be seen from FIG. 1, the stacker is made up of the stacker roller 1, the input transport system with the rollers 4 and 5 and the belts 6 and 7, the further output transport system with the rollers 8 and 9 and the belts 6 and 10, and the stacking part, which is made of the clearing unit 11 and a turningly supported stack weighting plate 12.

The stacker roller 1 is made up of a stator 12 and a rotor 3. The rotor 3, which is turned in the direction of the arrow 13 by belts 7 of the input transport system (there being a number of belts 7 side-by-side parallel to the plane of the figure) has a number of suction opening lines 14*a* to 14*d* (see FIG. 2 as well) which are normal to the plane of the figure, are on generatrices of the outer drum face and are adjacent to each other. Because a number of suction opening lines are present, there is a broader suction range on the outer face of the rotor, which is made clear in FIG. 1 by the angle range 22 marked in broken lines. The selection of the breadth of the suction range (number of suction opening lines) is such that even banknotes transported to the drum with the greatest possible slip "S" are nevertheless safely suction-gripped and stacked.

In the cylindrical outer face of the stator, over which the inner face of the rotor is air-tightly moved on turning, suction airways 15*a* to 15*c* are machined in the peripheral direction. They are joined by way of further airways 16 with a suction hole 17, which is joined with a vacuum pump not shown in the figure. The suction range of the stator 2 has its start at the tangential point "T" marked in FIG. 1 and its end at the stopping point or clearing point "A" at the level of the clearing unit 11.

If now, for example, a banknote 19 is to be stacked by the stacker in question, the airways 16 of the stator 2 are put under vacuum so that the suction range in the tangential point "T" will have the effect of suction-gripping the leading banknote edge, moving it as far as the stop point "A" and placing it on the stack weighting plate 12, or if some stack has been formed, on this stack 18. Banknotes which are not to be stacked by the stacker in question, are run by the output transport system, made up of the belts 6 and 10 and the rollers 8 and 9, to a later stacker.

Figure 2:
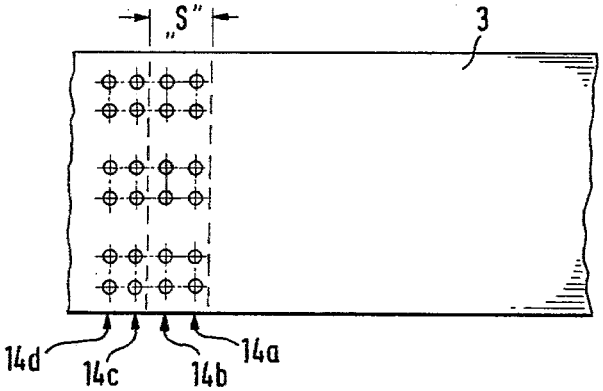
FIG. 2 is a view of part of the outer drum face with the suction openings.

In FIG. 2 part of the outer face of the rotor 3 is to be seen, in which, as an example of the invention, the rotor 3 has four suction opening lines 14*a*, *b* and *c* and *d*. In this case, the greatest possible slip "S" range goes over the suction opening lines 14*a* and *b*, which in the drawing are shaded.

Figure 3A:
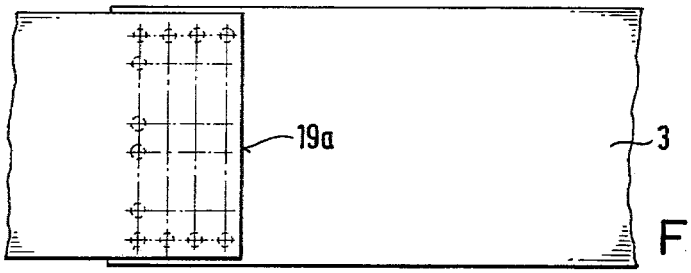
FIG. 3*a* is a view of part of the outer drum face together with a banknote run on to the face with the true, desired timing.

FIGS. 3*a* and *b* make clear the possible limiting cases in the position of the leading edge of the banknote within the rated slip range.

The banknote 19*a*, to be seen in FIG. 3*a*, has been moved up to the stacker with the desired timing, that is to say in step, so as to be covering all suction opening lines 14*a*, *b*, *c* and *d*, that is to say the complete suction range of the rotor 3, as will be seen from the figure.

Figure 3B:
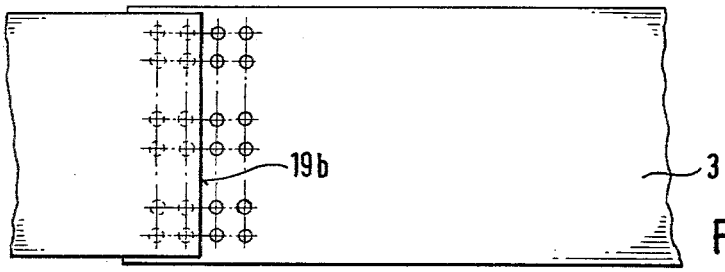
FIG. 3*b* is a view of part of the outer drum face with a banknote run on to it with the greatest amount of slip with which the stacker may be run.

The banknote 19*b* to be seen in FIG. 3*b*, has its leading edge at the limit of the rated slip range, so that it is only covering half the suction range present. In this case the suction opening lines 14*a* and 14*b* are uncovered. As a general teaching of the invention, the selection of the breadth and position of the slip range (shown in FIG. 2) is to be such that the greatest possible errors in timing of the incoming banknotes are taken care of and banknotes with the greatest possible error in position (slip) are still certainly suction-gripped.

Figure 4:
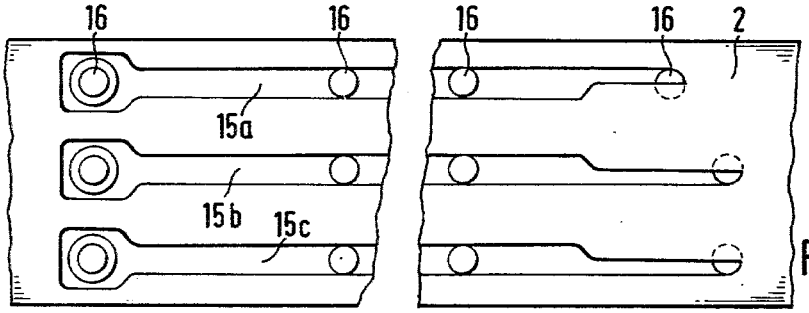
FIG. 4 is a view of part of the outer face of the stator with the section airways.

FIG. 4 is a view of part of the development of the outer face of the stator 2 with the positions of the suction airways 15*a*, 15*b* and 15*c*. As has been noted in connection with FIG. 1, the suction airways are joined by ways of airways 15 and the suction hole 17 with a vacuum pump.

Figure 5A:
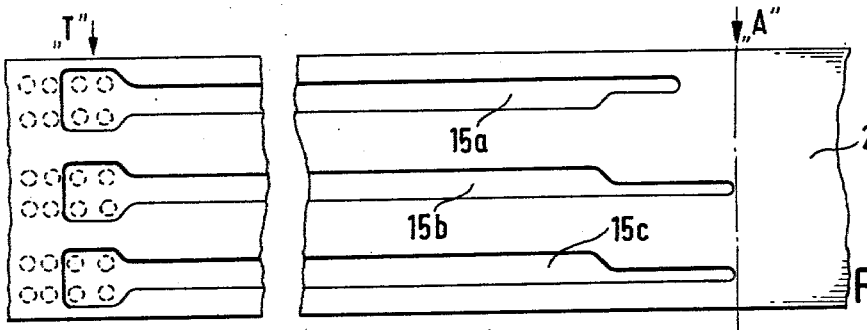
FIGS. 5*a*, 5*b* and 5*c* are views of the position of the suction openings in relation to the suction airways of the stator in different working stages.
Figure 5B:
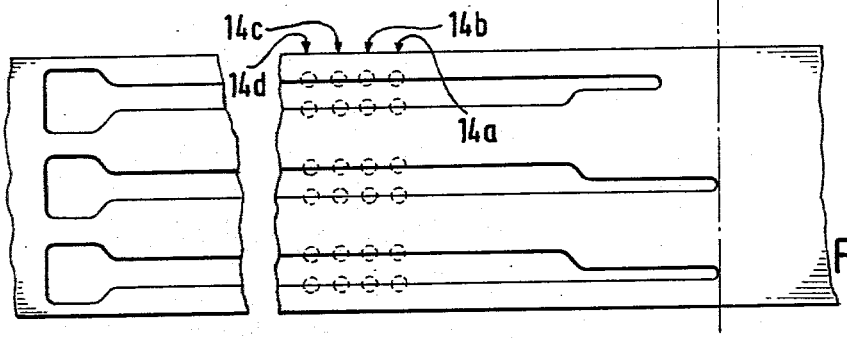
Figure 5C:
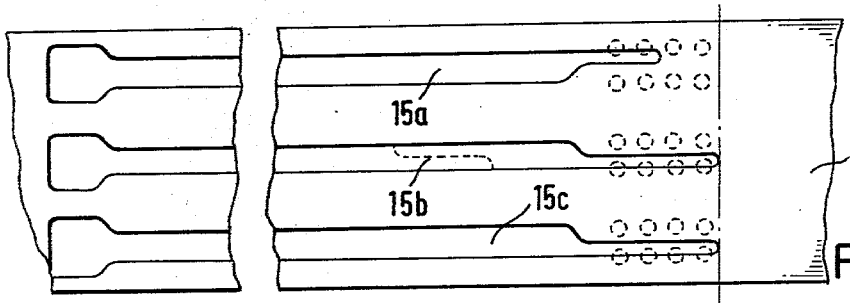

For making clear the separate working steps in the stacking operation in FIGS. 5*a*, 5*b* and 5*c*, the position of the suction openings 14*a*, *b*, *c* and *d* in relation to the suction airways 15*a*, *b* and *c* is to be seen in different working stages. Furthermore the tangential point "T" is marked, at which the banknotes are taken from the transport system and the stop point "A" marking the position of the clearing unit.

Generally at the tangential point "T" (FIG. 5*a*) the cross-section or the acting face of the suction airways 15*a*, 15*b* and 15*c* is so designed that the suction openings 14*a*, *b*, *c* and *d* are moved one after the other, in each case with their complete opening area in to the suction range, that is to say, they are turned on suddenly and not slowly.

Further on the suction airways of the stator (FIG. 5*b*) becomes narrower, so that the suction openings 14*a*, *b*, *c* and *d* in this part in each case have the greatest part of their opening area to the side of the suction airways 15*a*, *b* and *c* and, for this reason, only make possible a very much smaller air throughput rate.

Lastly the cross-sections of the suction airways 15*a*, *b*, and *c* are so formed and placed at distance in front of the stop point "A" (FIG. 5*c*) that a part of the suction openings, still acting in the stage of FIG. 5*b*, are now in positions fully to the side of the suction airways 15*a*, *b* and *c* and, for this reason, are completely cut off from the vacuum.

It is furthermore to be seen from FIGS. 5*a*, 5*b* and 5*c* that the top suction airway 15*a* comes to an end even short of the stop point "A", a more detailed account of this being given later.

For making clear the workings of the new stacker an account is to be given of two forces in this connection: that is to say the suction pulling force and the suction gripping force.

The suction pulling force is the force taking effect in front of the still open (uncovered) suction openings, that is to say the force of attraction moving the banknotes towards the suction drum. This force is dependent in the end on the air current moving between the banknote and the stacker drum because of the vacuum effect.

The suction gripping force is taken to be the force produced by the covered suction openings pushing the banknote against the suction drum. In the case of an unchanging degree of vacuum, an unchanged suction opening diameter from one opening to an other, and an unchanging coefficient of friction between the banknote and the suction drum the suction gripping force is only dependent on the number of acting suction openings.

Dependent on the size of the air current controlling the suction pulling force, the space between the banknote to be pulled up against the drum and the stacker drum is more less quickly cleared of air, so that the banknote is slowly or quickly sucked up against the drum. If the air current is overly low, the banknote will not be sucked up, against the drum, because the air cleared by suction will have its place taken at the same rate by air from the atmosphere, so that there will be no building up of a vacuum between the banknote and stacker drum. In the example of the invention in question, the air current is changed by changing the acting current cross-section or by turning off suction openings.

Figure 6:
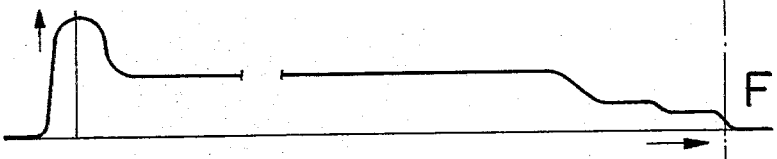
FIG. 6 is a curve to illustrate changes in the suction pulling force of the drum with changes in angle of the drum in line with FIGS. 5*a* to 5*c*.

FIG. 6 is used to show changes in the air current (suction pulling force) from the tangential point "T" to the stop "A" without a banknote on the drum. The form of the curve is dependent on the sum of the suction opening lines 14*a, b, c* and *d*.

As noted earlier at the tangential point "T" the leading edge of the banknote is to be pulled against the drum quickly and certainly. The complete cross-section of the suction openings 14*a, b, c,* and *d* takes effect (see FIG. 5*a*), because at this part, the suction airways 15*a, b* and *c* are broader, and the air current is very high in relation to the rest of the range at the tangential point. In this part it is only limited by the cross-section of the suction openings. After this the air current is greatly lowered by the increase in the resistance to the current, because in this part the suction openings only have a very small part of their cross-section over the suction airways 15*a, b* and *c* (see FIG. 5*b*). In this part between the tangential and stop or clearing points it is, for this reason, possible for the loss in suction power, caused by suction openings not being covered, to be greatly decreased.

Even at a small distance from the stop point "A", the air current is furthermore greatly decreased by the turning off of suction openings which had been acting so far until, in the end, the air current goes to a value of zero at the stop point. With this system it is possible to make certain, even at some distance in front of the stop point, that uncovered suction openings do not take up banknotes, which have been stacked at this position, once again.

Figure 7:
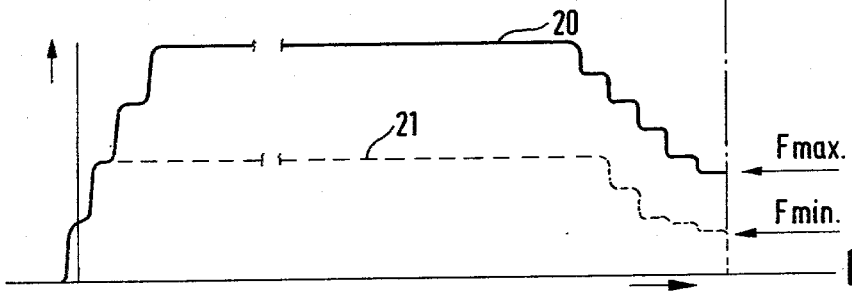
FIG. 7 is a curve to illustrate changes in the suction gripping force of the suction airways with different angles of turning in line with figures 5*a* to 5*c*, in the one case with the greatest possible degree of slip and in the other case with no slip.

The suction gripping force is only controlled, as noted earlier, by the number of acting suction openings, (if the vacuum level is not changed and if the suction opening cross-sections are the same), that is to say, under these conditions taken to be controlling, the suction gripping force may only be decreased by complete turning off of suction openings. The air resistance of the system does not have any effect on the suction gripping force as long as the air loss by leakage near the uncovered suction openings is made good or balanced. FIG. 7 is a view of two curves for the suction gripping force with the changes but not otherwise to scale, as will now be made clear.

The curve 20 is with respect to the banknote 19*a*, which, as is clear from FIG. 3*a*, has the effect of covering all suction openings 14*a, b, c* and *d* of the stacker drum. The curve is with respect to changes in the position of the leading edge of the banknote in relation to the suction airways.

In line with the motion of the suction openings, covered by the banknote, into the wider parts of the suction airways 15*a, b, c* (FIG. 5*a*), there is an increase in the suction gripping force "F", starting at a start value taking effect at the tangential point "T" quickly to the end value. While the suction-gripped banknote is moved round on the stacker drum (FIG. 5*b*), the suction gripping force is kept unchanging. It is only at a small distance before the stop point "A" (see FIG. 5*c*), suction openings are turned off step-by-step because the suction airways become narrower at this position, that there is a dependent decrease in the suction gripping force. At that point in time, at which the leading edge of the banknote has come as far as the stop point "A" or run up against the clearing unit, about half of the firstly-used suction openings will still be acting on the banknote. The force, acting on the banknote at this point in time, is given as $F_{max}$ in FIG. 7.

The force $F_{max}$ pushing the leading edge of the banknote against the stripping unit is so designed that the banknote is certainly not folded or fouled up.

The second curve 21, presented in FIG. 7 as well, is with respect to the banknote 19*b*, which, as will be clear from FIG. 3*b*, has the greatest possible system slip and is only covering half of the suction openings present, that is to say the rows 14*a* and 14*d*. For this reason, this banknote is only pulled towards the drum by half the force acting on a banknote covering all suction openings. This force has to be so great that, once the banknote has been pulled up against the drum, it is certainly suction-gripped as the stacker drum is turned.

Like the first curve, in this case as well, the suction gripping force undergoes a stepwise decrease at some distance in front of the stop point "A," the leading edge of the banknote lastly only being forced against the clearing unit with about half the suction gripping force acting in the first place. This force is marked $F_{min}$ in FIG. 7 and is so designed that even a banknote with the greatest possible slip or timing error is still certainly moved as far as the stop point "A".

These two limiting cases are at the ends of a working range between the greatest possible and smallest possible force ($F_{max}$ minus $F_{min}$). So within this working range, keeping to a rated slip range, orderly and troublefree stacking of banknotes is made possible all the time.

Taking into account the quality of the banknotes and how rough the stacker drum is, it has turned out that generally in operation (as a tangentially acting suction gripping force) the best range for $F_{max}$ is 150 p to 200 p and the best range for $F_{min}$ is 30 p to 50 p (p=pound).

As noted earlier in connection with FIGS. 5*a*, 5*b* and 5*c*, the top suction airway 15*a* comes to an end at a point short of the other suction airways 15*a, b,* and *c*, so that in the pulling on stage right before the stop "A" the suction gripping force produced takes effect generally in the lower third of the banknote leading edge. The useful effect here is that banknotes, which have their back edge turned upwards and, for this reason, firstly have their top leading edge pushed against the clearing unit, are, to a certain degree, righted, because the pulling force produced by the clearing unit on the banknote, will be responsible for moving the trailing edge of the banknote back into a parallel position, this making certain that the banknote, after being stacked, does not have its trailing edge sticking out of the stack formed.

In the working example of the invention given in the figures only a simple form of the invention has been given, which in part has only been presented in enough detail for making the teachings of the invention clear. Without giving up the base-teaching of the invention of which an account has been given, changes may be made in the stacker dependent on the field of use and on the building up of experience in operation.

For example, the suction openings in the suction opening range may be such that the slip range is made much greater, the suction gripping force produced being kept unchanging. In the case of the working example of the invention figured, it is a question of four lines of suction openings, which are placed one after the other in the direction of transport and in the case of which there are six suction openings in each line. In the further possible system of the invention it would then only be a case of having three openings in each line of which there would be eight, placed one after the other in the direction of transport.

Furthermore based on experience and taking into account the nature of the material to be stacked and the speed of stacking, it is not completely necessary for the suction airways of the stator to be machined as far as the clearing unit, and in fact, in the case of high speed and the right sort of material to be stacked, it will certainly be in order if all suction airways of the stator come to an end some distance short of the stop point, when even after the vacuum is turned off the material will be kept on the drum by inertia.

More specially the middle suction airway 15*b* may come to an end before the others, because the effect of the vacuum in the middle part of a banknote is less quickly overcome than at the edge parts, (see broken lines in FIG. 5*c*).

Lastly, dependent on the sort and quality of the material to be stacked, the likely amount of dust and dirt has to be taken into account. As will be seen even from FIG. 4, it is of good effect in this connection for the airways 16, joining the stator suction airways 15*a, b* and *c* with the vacuum pump, to be so placed and designed that there is as little as possible "dead space" (space with little or no motion of air) in which dust might come to rest. As will be clear from FIG. 4, for this purpose the further parts of the airways 16 are placed, as well, at the end zones of the stator suction airways 15*a, b* and *c* and matched in cross-section with the suction airways. The stator suction airways themselves are furthermore so designed that there is as little dead space as possible.

I claim:

1. A stacker apparatus for flat material sheets, said apparatus having a suction drum rotatably supported on a cylindrical stator for gripping the sheets at their leading edges when applied at a first tangential position, arcuately moving them, and releasing them on a stack at a second tangential position, said suction drum having a circumferentially extending section containing a plurality of suction openings for gripping said sheets, said stator having a plurality of suction channels communicating with said suction openings extending over a predetermined portion of the periphery thereof, the dimension of said channel normal to the peripheral extension decreasing step-wise from said first tangential position to said second tangential position, such that said suction openings are initially in full communication with said channels, thereafter are partially closed, and thereafter selected ones but not all of said suction openings are completely closed as said drum rotates from said first tangential position to said second tangential position.

2. The stacker apparatus according to claim 1 wherein said suction drum has at least a pair of suction openings communicating with each of said suction channels, both suction openings of said pair initially fully communicating with the respective suction channel, thereafter both of said openings being partially closed, and thereafter, one of said suction channels being completely closed.

3. The stacker apparatus according to claim 1 wherein said suction drum has a single suction opening communicating with each of said suction channels, each of said openings initially fully communicating with the respective suction channel, thereafter said opening being partially closed, and thereafter, said opening being completely closed.

4. The stacker apparatus according to claim 1 for stacking flat sheet material on edge, wherein said suction drum is vertically arranged and wherein said suction openings are vertically spaced on said suction drum and wherein the upper suction opening is closed before the other suction openings.

5. The stacker apparatus according to claim 1 wherein said suction openings are arranged in a line parallel to the axis of said suction drum and wherein a central suction opening is closed before the other suction openings.

6. The stacker apparatus according to claim 1 wherein the flat sheet material has a slip range of variable application position on said suction drum and wherein said section of said suction drum containing said suction openings occupies a sufficient circumferential length so as to insure that the flat sheet material is gripped when applied to the drum within said slip range.

* * * * *